United States Patent [19]

Bauer et al.

[11] Patent Number: 4,481,961

[45] Date of Patent: Nov. 13, 1984

[54] METHOD FOR SETTING HAIR AND A DEVICE FOR CARRYING OUT THE SAID METHOD

[75] Inventors: Daniel P. Bauer, Le Raincy; Jean-Paul H. Beck, Paris; Jean-Claude J. Grognet, Villers S/Coudun, all of France

[73] Assignee: L'Oreal, Paris, France

[21] Appl. No.: 267,548

[22] Filed: May 27, 1981

[30] Foreign Application Priority Data

May 30, 1980 [FR] France ..... 80 12110

[51] Int. Cl.[3] ..... A45D 7/00

[52] U.S. Cl. ..... 132/7; 424/70

[58] Field of Search ..... 132/7, 9, 33 R, 40, 132/88.5, 88.7; 338/22; 219/358, 504–505, 469, 483; 34/99; 424/70

[56] References Cited

U.S. PATENT DOCUMENTS

| | | | |
|---|---|---|---|
| 1,504,567 | 8/1924 | MacDonald et al. | 132/33 R |
| 1,678,983 | 7/1928 | Hall | 132/33 R |
| 1,932,519 | 10/1933 | Harris | 132/7 |
| 1,933,021 | 10/1933 | Maeder | 132/7 X |
| 3,934,596 | 1/1976 | Suntheimer | 132/9 |

FOREIGN PATENT DOCUMENTS

| | | | |
|---|---|---|---|
| 38855 | 3/1979 | Japan | 132/7 |

*Primary Examiner*—Gregory E. McNeill

*Attorney, Agent, or Firm*—Cushman, Darby & Cushman

[57] ABSTRACT

A method and device for setting hair relies on the use of a hair setting process in which, after partial drying but before unrolling of the hair from curlers or rollers on which it is wound after moist treatment, the hair is subjected to a conditioning step in an atmosphere having a relative humidity of from 36 to 80% at a temperature of from 35° to 75° C. and for a period of from 5 to 60 minutes.

16 Claims, 7 Drawing Figures

METHOD FOR SETTING HAIR AND A DEVICE FOR CARRYING OUT THE SAID METHOD

BACKGROUND OF THE INVENTION

The present invention relates to a new method for setting hair, and to devices for the implementation of the method. The method according to the invention finds its application either in wave setting, or straightening either of a head of hair or of a wig made of natural hair which is considered to be too curly in its natural state.

The method according to the invention gives the hair a shape which is not permanent, that is to say, a temporary shape which disappears when the hair is wetted again, in particular when it is subjected to shampooing. The difference between the temporary deformation imparted by the process according to the invention and a permanent deformation (e.g. permanent set or "perm") involving a chemical treatment lies in the fact that the hair having undergone the deformation process according to the present invention will, when wetted again find the shape it had before the application of the process, whereas after a permanent deformation the shape of the hair is not altered by wetting or washing.

For the convenience of language, reference will be made throughout the present specification and claims to the process of setting, it being understood that this term must be deemed to include the straightening without chemical treatment; similarly, although reference will be made to a head of hair it should be understood that this term must be deemed to include wigs of natural hair.

SUMMARY OF THE PRIOR ART

The most frequently used process for hair setting starts with set hair which is rolled on supports called "curlers" or "setting rollers", followed by drying the hair under a hood at a temperature of from 30° to 60° C. during a period which may vary from 20 to 60 minutes depending upon the mass of hair to be dried, and then finally unrolling of the curlers and "combing out" the coiffure. In a variant, the initial moist treatment is obtained by means of a setting lotion which may be constituted, for instance, by a solution of stiffening agents such as resins which, after drying, cover the hair and keep it in position.

It has been found that hair submitted to such a known setting process shows a behaviour evolving with time after the end of drying. In the first place, it has been found that the moist treatment to which the hair is submitted during wetting with water or shampooing, produces an increase in the weight of the hair, the relative variation in weight being of the order to 35%. The drying of the hair in a warm air flow entails a water loss greater than the weight increase of the hair during the moist treatment and, at the end of drying, the relative variation in the hair weight in relation to the weight before the moist treatment has generally ended up at approximately −9%. This weight loss essentially depends on the drying, in particular on its duration, and on the temperature of the drying air flow. When the drying has been completed, it will be found that the hair gradually takes up moisture from the surrounding air and this behaviour of the hair has been represented in FIG. 1 in the attached drawing; generally, the return of the hair to the weight which it initially had before the moist treatment is effected over several hours.

When a set has been obtained by the above-mentioned known process, the hair is unrolled from the curlers immediately after drying and, at this time, it has a curliness approximating to that which may be deemed to be ideal with regard to the curlers used. To determine the curliness, one may experimentally obtain a set on a lock of hair and, at the time of unrolling the hair, suspend the lock and make a note of the length of the said lock. If the lock of hair is then left suspended thus and hence subjected to the action of its own weight in contact with the outside atmosphere, it will be found that the length of the lock increases over a period of time, this phenomenon taking place at the same time as the renewed water intake previously referred to. It follows from this that the efficiency of the set disappears gradually in the course of time; this, of course, constitutes a by no means negligible drawback. It has now been found that this phenomenon is very considerably affected by the time when, on termination of the drying, the hair was unrolled by removing the curlers. It has, in fact, been found that if the hair is left in place on the curler for a certain time after the end of drying, the elongation of the suspended locks over a period of time is considerably retarded or reduced. The curves shown in FIG. 2 illustrate this phenomenon; in these curves, the time expressed in hours has been plotted on the x axis and the length of a suspended lock of hair expressed in millimeters as shown on the y axis, the time Δ expressed in hours having been given as a curve parameter where Δ represents the time which elapsed between the end of drying and the unrolling of the curls. It will be seen that immediately on termination of the drying, all the locks have curls having substantially the same suspended length $L_O$; the curve which would correspond to an ideal retention of the set, that is to say the retention of the shape acquired by the hair with the passage of time, has been indicated by a dot-dash line.

Studying the curves of FIG. 2, it will be seen that to obtain a satisfactory result, it would be desirable to keep the curlers in for a very long time after the end of drying. Now the renewed water intake after the end of drying is effected relatively rapidly as shown in FIG. 1. It will therefore be found that, subsequent to the end of the water intake of the hair, a phenomenon occurs which has a very considerable effect on the maintenance of the set in the course of time. It is thought, without this explanation being in any way restrictive, that the said phenomenon is a rearrangement of the molecules constituting the hair; if this rearrangement occurs while the hair is still rolled on the curlers, the lasting effect of the set is clearly greater than that where the rearrangement occurs after the hair has already been unrolled.

By way of a purely explanatory hypothesis, and without this being capable of constituting a limitation of the invention in any way, it is thought that the moist treatment of the hair allows the penetration of water into the hair and increases the dielectric constant of the medium obtaining between the charged site of the molecules constituting the hair so that the hydrogen bonds no longer exist for the dampened hair. When the drying is effected, the water molecules are extracted from the hair in such quantities that there will be a noticeable loss of weight in relation to the initial weight; the charged sites of the molecules constituting the hair which have been kept at a distance because of the presence of the water molecules remain relatively separated and, at the ambient temperature, do not instantly facilitate the establishment of the hydrogen bonds, this re-formation taking place only gradually at a relatively slow rate. The water molecules which reenter the hair at the ambient temperature during the renewed water intake after the end of the drying process are in the form of agglomerates which are the greater the lower is the temperature, and the rearrangement of these water molecules in the hair is a slow process. It will thus be seen that the rearrangement of the water distribution in the hair on the one hand, and the re-formation of the hydrogen bonds in the hair on the other hand, are phenomena which at the ambient temperature occur slowly and which probably constitute that which has previously been called the rearrangement of the hair.

SUMMARY OF THE INVENTION

According to the present invention we provide a method for setting hair, comprising subjecting the hair to a moist treatment; rolling the hair on appropriately shaped means serving as curlers; drying the hair thus rolled up and, before unrolling the hair but after it has been sufficiently dried to show a loss of water in relation to its initial state before the moist treatment, subjecting the hair, over a time of from about 5 to 60 minutes to a conditioning step carried out in an atmosphere having a relative humidity of from about 35 to 80%, at a temperature of from about 35° C. to 75° C.; and unrolling the hair after drying. It has been considered that with this new process the rate of the rearrangement of the hair during the subsequent renewed water intake could be increased by increasing the temperature at which this rearrangement takes place. It has also been found highly desirable to ensure that during this rearrangement the renewed water intake of the hair brings it back into an approximate state of hygrometric balance with the outside atmosphere at the ambient temperature. It has therefore been envisaged that according to the present invention the drying of the hair should be followed by the conditioning step during which a relatively high humidity rating is maintained in order to facilitate the renewed water intake of the hair; which water intake is necessary because at the end of the drying process the hair always shows a loss of weight in relation to the initial weight before the moist treatment. To obtain rapid rearrangement after drying, it has been found necessary to condition the hair in the atmosphere having a temperature of from substantially 35° C. to 75° C., and having a relative humidity of from substantially 40 to 80% approximately.

Moreover, it has, surprisingly, been found that it was necessary for the partial drying to be continued up to a point where the hair shows a water loss in relation to its initial condition and the subsequent conditioning step would then necessarily have to ensure a renewed water intake by the hair. In fact, if the drying is stopped when the hair has exactly regained its initial weight before wetting, it will be found that the rearrangement expected of the conditioning step proposed in accordance with the present invention does not materialise completely.

All things being otherwise equal, it has been found that the efficiency of a set according to the invention was a function of the relative humidity during the conditioning stage, the said function presenting a maximum where this relative humidity corresponds to the relative humidity of the outside atmosphere with which the hair is coming into contact again after the end of the conditioning step. Moreover, it has been found that, all things being otherwise equal, the efficiency of the set increases if the temperature during the conditioning step is increased. These two phenomena are reflected in the curves shown in FIGS. 3 and 4. In FIG. 3, the efficiency is plotted on the y axis, the percentage relative humidity is plotted on the x axis, the time and temperature of the drying process as well as the duration of the conditioning step and the relative humidity during the conditioning step constituting parameters of a given value. In FIG. 4, the efficiency expressed in % is plotted on the y axis, the conditioning temperature expressed in °C. is plotted on the x axis, the time and the drying temperature as well as the conditioning time and relative humidity during the conditioning stage constitute parameters of a given value. In FIG. 4, the shaded parts of the drawing correspond to a zone which cannot be attained since, from the considerations of comfort of the users of the process, the temperatures could not be withstood. In the case of the two curves of FIGS. 3 and 4, the efficiency is expressed as a percentage of improvement in relation to the length of the control locks which have been submitted to a conventional set with continuous drying at 60° C. during a total elapsed time equal to the overall treatment time of the process according to the invention, followed immediately by an unrolling of the locks of hair in a standard atmosphere (for instance at 26° C. and at 56% relative humidity).

It should be observed that the process according to the present invention is altogether different from the hair treatment processes which up to now have envisaged the treating of hair with steam. In fact, it is known that one setting technique of the conventional type subjects dry hair to an air and steam mixture at a level which may be tolerated by the scalp, this mixture being projected towards the hair by means of a hair dryer hood or a hand hair dryer. In this case, there is no use of the sequence of drying and conditioning steps which have been found to be necessary in accordance with the invention to achieve a good setting efficiency and a good lasting effect with respect to time.

In French Pat. No. 2 273 492, it has also already been proposed to subject the hair to the action of superheated steam over a period of approximately 1 to 60 seconds; in this process, the superheated steam action is, on the one hand, effected within too short a time for the restructuring of the hair after drying to occur and, on the other hand, the atmosphere around the hair during the steam treatment has a relative humidity of 100% which is very different from a relatively limited humidity such as that proposed for the conditioning step of the method according to the present invention. It has, in fact, been found that when the conditioning step of the process according to the invention was practised with a relative humidity of 100%, the setting efficiency tended towards zero. Thus a treatment of the type recommended in Swiss Pat. No. 349 373 may be worthwhile in the field of hair dyeing but produces a zero result as far as the setting effect is concerned.

When applying the method of this invention, an improvement in the lasting effect of the set is noticed. The hair is soft, shiny, easily dressed and non-electric; the head of hair has more body.

In a preferred form of the method according to the invention, the relative humidity value during the conditioning step is fixed at a value near to the relative humidity rating of the surrounding atmosphere with which the hair will be in contact on being unrolled; the temperature will be maintained during the conditioning step at a value of from substantially 45° to 60° C., and preferably approximating to 50° C.; the temperature of the atmosphere in which the hair is located during the conditioning step will be maintained at a value near the temperature during the hair drying phase; during the conditioning step, the hair will be given a new moisture intake which (as a percentage in relation to the weight of the hair before the moist treatment) only differs from the weight loss during drying (expressed as a percentage in relation to the weight of the hair before the moist treatment) by less than 2%; the conditioning step is maintained over a period of from substantially 10 to 20 minutes; the conditioning step is obtained by introducing steam into the atmosphere around the hair; during the conditioning step, a treatment product (as herein defined) is introduced into the atmosphere wherein the hair is located.

By the term "treatment product" is meant a product normally used in cosmetics such as anti-seborrheic, anti-dandruff, anti-drop agents, film-forming resins, deodorants, disinfectants, perfumes, brilliantine and similar substances.

The hair drying will advantageously be carried out to attain a relative humidity approximating to 15% in the atmosphere surrounding the hair; the hair drying will be carried out long enough to obtain a loss in weight (in relation to the weight of the hair before the moist treatment) of from 1 to 15% and preferably from 5% to 15%; the hair drying is carried out at a temperature of from 40° to 75° C. during a time of from 10 to 60 minutes; the hair drying is carried out by an air flow taken from the outside and heated in an open circuit.

Provision may be made for the initial moist hair treatment to be a wet treatment with water, and/or a shampoo, and/or a cosmetic treatment involving the wetting of the hair by an aqueous or water/alcohol solution, for example a solution of setting agents such as resins; after unrolling of the hair, a non-wetting cosmetic treatment may be applied to it such as a spray of lacquer.

In the case where the method is intended to obtain a wave set, the means serving for the rolling of the hair are curlers or setting rollers; in the case where the method is intended to obtain a straightening of the hair, the means serving for the rolling of the hair are rollers having a diameter larger than that of a normal setting roller. The hair treated by the process according to the present invention may be natural, bleached, tinted or permed hair.

The present invention also provides a device for use in carrying out the method of this invention, comprising means for drying damp hair and means to control the relative humidity value of the atmosphere around the hair.

In a first embodiment, the device according to the invention is constituted by two distinct apparatuses, namely means for drying the hair and means for effecting the conditioning step in a more humid atmosphere; the means for drying the hair may be a drying hood of the conventional type; the means for effecting the conditioning step may be a vapour enclosure with a gentle air circulation.

In a second embodiment, the device according to the invention is constituted by a single apparatus having two successive cycles, one corresponding to the drying and the other to the conditioning step. In a first variant, the apparatus is constituted by a flexible hood placed on the head of hair to be treated and supplied with hot air by tubing connected to a heating and/or a humidifying device. In another variant, the apparatus is constituted by a drying hood of the conventional type fitted with means for introducing steam into the heating air flow during the conditioning step; the start of the steam introduction may be triggered automatically either in response to completion of a predetermined drying time or in response to attainment of a predetermined relative humidity value in the atmosphere; the steam introduction may be controlled by a regulator maintaining the relative humidity rating of this heating air at a constant value.

BRIEF DESCRIPTION OF THE DRAWINGS

In order that the present invention may more readily be understood, there will now be described several embodiments by way of purely illustrative and non-restrictive examples. The accompanying drawings provide explanatory curves relating to the method according to the invention and schematic representations relating to the devices for carrying out the method.

In these drawings.

PREFERRED EMBODIMENTS OF THE INVENTION

Figure 1:
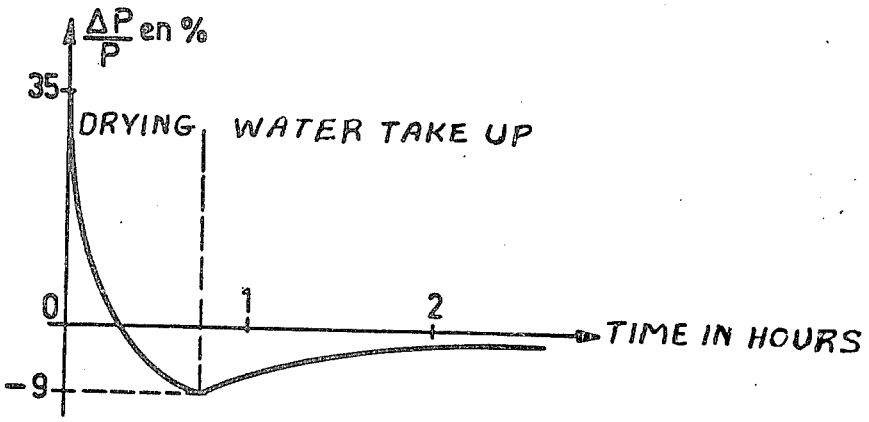
FIG. 1 represents the curve giving the percentage relative variation of the weight, with respect to time, of wet hair being subjected to a drying process at 60° C. for 45 minutes, then left in an atmosphere at 26° C. and at a relative humidity of 56%.

FIG. 1 shows that, as has already been indicated at the start of the present specification, hair does sustain an increase in weight of 35% when it is wetted and then returns by means of a drying within 45 minutes at 60° C. to a weight which is 9% below its initial weight. The hair left in an atmosphere at 26° C. and a 56% relative humidity does approximately regain its initial weight about two hours after the end of the drying process.

Figure 2:
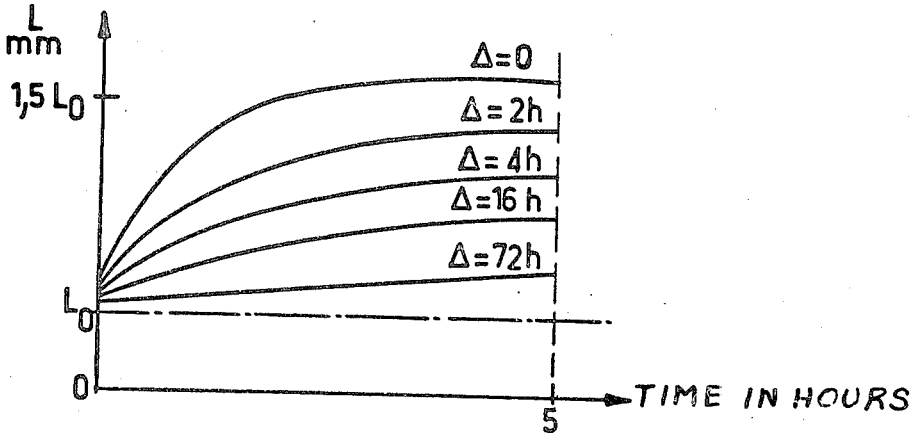
FIG. 2 represents a set of curves showing the length variation of hair subjected to a setting process of the conventional type, the parameter Δ of the set of curves being the time elapsed between the end of the drying process and the unrolling of the hair.

FIG. 2 gives the variation of length L of a lock of hair (expressed in millimeters) as a function of time t (expressed in hours) when, as has also been indicated at the start of the present specification, the lock, having been subjected to a setting process of the conventional type, is unrolled from its curler at a time Δ counted in hours from the end of the drying process. It will be seen that the efficiency of the set decreases very rapidly if the hair is not kept on the rollers for a relatively long time after the end of drying. Now it is quite clear that such a constraint cannot be borne by the users of a hair setting process and it follows therefrom that conventional sets are effective only for a very short time.

By way of experiment, sets implementing the method according to the invention have been effected on locks of both natural and bleached hair.

Tables I and II give the experimental results for a procedure involving a 45 minute drying process at 60° C. by means of a dryer hood with air flow, followed by a conditioning step whose characteristics are given in the first column of Tables I and II; HR denotes the relative humidity ratings during the conditioning step, and $\theta_c$ is the temperature of the atmosphere surrounding the hair during the conditioning step. The duration of the conditioning step (expressed in minutes) is indicated in the second column of these two Tables. In the third column of these Tables, there appear the lengths of the locks subjected to the setting method of the invention measured after having been suspended for a period of 5 hours counted from the time of unrolling from their supporting curlers. A control lock, used for the purpose of comparison, has sustained the drying operation in the conditions indicated above but has not been subjected to any conditioning step but simply unrolled immediately after drying. The ratio of the length of a lock treated by the method according to the invention to the length of the control lock (the two measurements both being effected five hours after the unrolling of the locks) gives the improvement in % afforded by the method according to the invention; this improvement is indicated in the fourth column of Tables I and II. Finally, the fifth column of the two Tables gives the renewed water intake of the treated locks five hours after the end of the treatment.

It is clear from the results of Tables I and II that over the whole relative humidity range that has been explored, both as regards natural hair and bleached hair, the method according to the invention allows a very significant percentage of improvement to be obtained. It should be noted that the relative humidity of 56% at which some of the experiments had been carried out, corresponds to the relative humidity of the outside temperature with which the locks are brought into contact after the end of the treatment. It will be found that for a relative humidity rating of 56%, and for natural hair, the efficiency of the conditioning step is already very satisfactory after only 15 minutes of conditioning. This finding is extremely interesting because the users of the process are generally reluctant to withstand an increase of the total treatment time intended to obtain a set. The usual treatment comprises a drying period of 45 minutes and it is therefore desirable to be able to bring the total time required for the method according to the invention near this value of 45 minutes. Now it has been found that using a drying period of thirty minutes followed by a conditioning step at 50° C. and a relative humidity rating of 56%, the results were clearly better than with a conventional process when the drying had been continued for 45 minutes at the same temperature of 60° C. It may therefore be contemplated to effect, in all, a drying period of 30 minutes at 60° C. followed by a conditioning step lasting 15 minutes at a relative humidity rating of 56% and 50° C., which allows an improvement of 28% to be obtained without any increase in total treatment time in relation to a conventional setting method. It is quite clear that the multiplicity of the prevailing parameters makes it possible to search for an optimum, taking particular cases into account.

In Table III, there have been entered the results obtained with natural hair whilst varying the drying time at 60° C., on the one hand, and the conditioning parameters, on the other hand, (HR and $\theta_c$ have the same meanings as in Tables I and II). In this Table III, the percentage of improvement and the percentage of the renewed water intake have been calculated as indicated above for Tables I and II.

Figure 3:
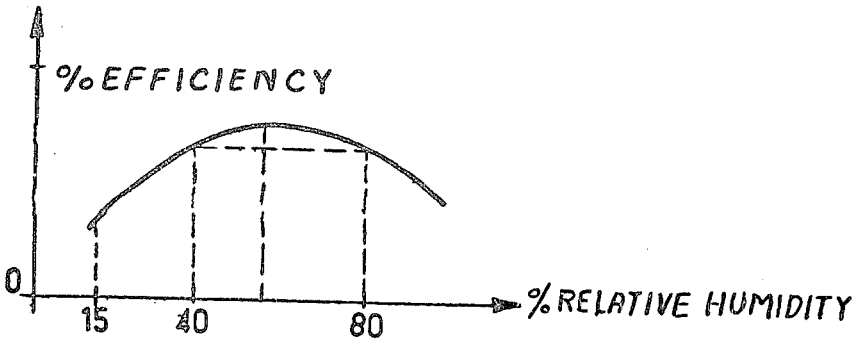
FIG. 3 represents the variation of efficiency of the method according to the invention in dependence upon the relative humidity value during the conditioning step.

FIG. 3 schematically conveys the experimental results entered in Tables I, II and III on a curve. This curve shows the variation of the percentage efficiency of the method according to the invention (plotted on the y axis) in relation to the percentage relative humidity rating during the conditioning step, the efficiency being recorded by the improvement calculated in the penultimate column of Tables I, II and III; this graph shows the general shape of the curve and assumes constant values for the other parameters, that is to say, the drying temperature (60° C.) the drying time (30 minutes), the conditioning temperature (50° C.) and the conditioning time (15 minutes).

Figure 4:
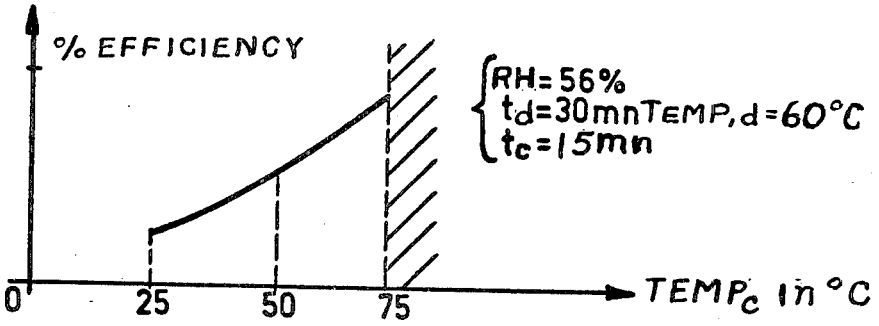
FIG. 4 represents the efficiency variation of the method according to the invention in accordance with the temperature during the conditioning phase.

In the same way, FIG. 4 schematically shows the shape of the efficiency variation curve of the method according to the invention in relation to the conditioning temperature adopted. The efficiency indicated on the y axis is calculated in the same way as for the y axis of FIG. 3. The conditioning temperature is indicated on the x axis and expressed in °C.

The other parameters are kept constant, that is to say, the drying time (30 minutes), the drying temperature (60° C.), the conditioning time (15 minutes) and the relative humidity rating of the conditioning (56%).

TABLE I

| BLEACHED HAIR | | | | |
|---|---|---|---|---|
| CONTROL | | L in mm. 190 | Improvement in % 0 | Renewed water intake in % +8% |
| Particulars of the Conditioning | Duration of the Conditioning | | | |
| $\theta_c$ = 50° C. | 15 | 128 | +32.5% | +2% |
| HR = 40% | 30 | 123 | +35.0% | +1.5% |
| | 60 | 120 | +36.8% | +1.2% |
| $\theta_c$ = 50° C. | 15 | 165 | +13.0% | +2% |
| HR = 56% | 30 | 120 | +37.0% | 0% |
| | 60 | 108 | +43.0% | +0.7% |
| $\theta_c$ = 50° C. | 15 | 108 | +43.1% | −0.6% |
| HR = 75% | 30 | 128 | +32.6% | −1% |
| | 60 | 125 | +34.2% | −0.9% |

TABLE II

| BLEACHED HAIR | | | | |
|---|---|---|---|---|
| CONTROL | | L in mm. 220 | Improvement in % 0 | Renewed water intake in % +8% |
| Particulars of the Conditioning | Duration of the Conditioning | | | |
| $\theta_c$ = 50° C. | 15 | 185 | +15.9% | +1.5% |
| HR = 40% | 30 | 203 | +7.7% | +2.3% |
| | 60 | 183 | +16.8% | +1.6% |
| $\theta_c$ = 50° C. | 15 | 175 | +20.0% | +0.7% |
| HR = 56% | 30 | 165 | +25.0% | +0.7% |
| | 60 | 141 | +36.0% | +0.5% |

TABLE II-continued

| BLEACHED HAIR | | | | |
|---|---|---|---|---|
| CONTROL | | L in mm. 220 | Improvement in % 0 | Renewed water intake in % +8% |
| Particulars of the Conditioning | Duration of the Conditioning | | | |
| $\theta_c$ = 50° C. HR = 75% | 15 | 185 | +16.0% | −0.6% |
| | 30 | 186 | +15.5% | −1.2% |
| | 60 | 188 | +14.5% | −0.9% |

TABLE III

| NATURAL HAIR | | | | |
|---|---|---|---|---|
| | Conditions of Conditioning | Duration of Conditioning | Improvement in % | Renewed Water Intake in % |
| Drying process 30 mn 60° C. | HR = 56% $\theta_c$ = 50° C. | 5 | 17 | 1.2 |
| | | 15 | 28 | 0.5 |
| | | 30 | 25 | 0.2 |
| | | 60 | 27 | 0.2 |
| | HR = 75% $\theta_c$ = 50° C. | 5 | 23 | 0.6 |
| | | 15 | 19.5 | −0.9 |
| Drying process 45 mn 60° C. | HR = 56% $\theta_c$ = 50° C. | 5 | 14 | 1.5 |
| | | 15 | 20 | 0.7 |
| | | 30 | 25 | 0.7 |
| | | 60 | 36 | 0.5 |
| | HR = 75% $\theta_c$ = 50° C. | 5 | 12 | 0.8 |
| | | 15 | 16 | −0.6 |
| | | 30 | 15.5 | −1.3 |
| | | 60 | 14.5 | −0.9 |
| | HR = 56% $\theta_c$ = 60° C. | 30 | 28 | — |
| | HR = 35% $\theta_c$ = 75° C. | 30 | 18 | — |
| | HR = 78% $\theta_c$ = 50° C. | 15 | 20 | — |
| | | 30 | 34 | — |
| | | 60 | 25 | — |

For the implementation of the method according to the invention, it is proposed to use several types of device.

Figure 5:
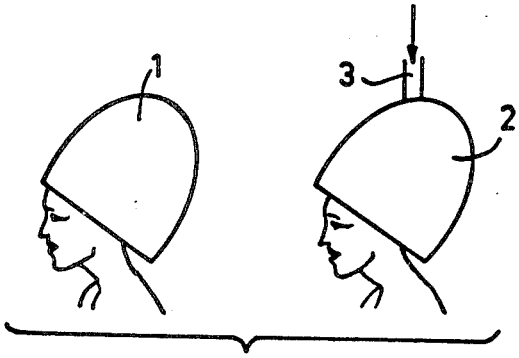
FIG. 5 shows schematically two types of apparatus which constitute the first embodiment of the device for carrying out the method of the invention.

The first type of device is shown schematically in FIG. 5. It comprises firstly a dryer hood 1 of the conventional type intended to perform the drying stage of the setting procedure according to the invention, and secondly a vapour enclosure 2 distinct from the dryer hood 1, the said vapour enclosure being supplied by tubing 3 so that a relatively constant humidity rating should be maintained therein. The temperature within the vapour enclosure 2 is also kept constant. The user who has undergone a hair wetting, either with water alone or by means of a shampoo and rinse (possibly with the application of a setting agent capable of polymerisation), rolles her locks of hair (or has them rolled) on curlers and places her head under dryer hood 1 during the drying time. At the end of this drying time, the user places her head of hair into the vapour enclosure 2 and keeps it in there during the scheduled conditioning time. Subsequently, the user removes her curlers by unrolling the hair and performs a finishing comb out.

Figure 6:
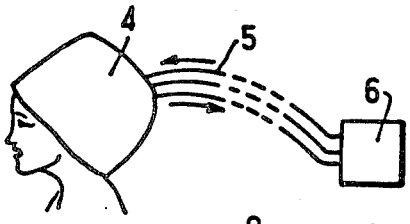
FIG. 6 schematically shows an apparatus constituting a first variant of a second embodiment of the device implementing the method according to the invention.

The second embodiment of the device according to the invention is schematically represented in FIG. 6. In this Figure, it will be seen that the user whose hair has been wetted and rolled on rollers as indicated above, places her head of hair inside a flexible hood 4 made, for instance, of a plastic material, the said hood being connected by a conduit 5 to a heating and/or humidifying device 6. During the drying stage, device 6 supplies hot air to the hood 4 and the air is extracted by the conduit 5 which serves both for the intake and extraction of the air; the drying air is evacuated into the outer atmosphere. When the drying stage is terminated and when the conditioning stage commences, the air flow ensured by device 6 is no longer effected in an open circuit but in a closed circuit and device 6 adds a quantity of water to the air flow sufficient to maintain a constant relative humidity rating within hood 4. Instead of water, there may be introduced into the air during the conditioning stage an aqueous or hydroalcoholic treatment liquid for the hair or scalp.

Figure 7:
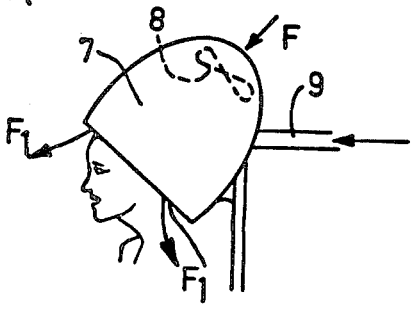
FIG. 7 schematically shows an apparatus constituting a second variant of the second embodiment of the device implementing the method according to the invention.

In another embodiment shown in FIG. 7, it will be seen that the device according to the invention is formed by a dryer hood 7 of the conventional type which is modified to allow the implementation of the method according to the invention. The dryer hood 7 is fitted with a fan 8 which draws in outside air along the direction of arrow F and directs it, after heating, towards the head of hair, the extracted air emerging from the user's hood along the directions of arrows F1. Hood 7 is fitted with a device 9 allowing a quantity of steam to be introduced into the hot air to maintain a constant relative humidity rating. After the wetted hair of the user has been rolled on the curlers, the head of hair is placed under hood 7 and the drying stage of the process is commenced. When the drying time has been completed, the steam (or a treatment liquid in a vaporous state) is introduced by way of a conduit 9 during the whole of the conditioning step, the vapour quantity being adjusted so as to maintain a constant relative humidity rating around the head of hair.

It shall be duly understood that the modes of implementation and the embodiments described above are in no way restrictive, and may give rise to any desirable modifications without thereby departing from the scope of the invention.

We claim:

1. A method for non-permanently shaping or setting hair comprising (a) moisturizing said hair, (b) rolling said moisturized hair on hair shaping means, (c) drying said rolled up and moisturized hair to the extent that, by removal of water therefrom, the weight of the resulting dried hair is 1 to 15 percent less than the weight of said hair prior to moisturizing said hair, (d) conditioning said dried and rolled up hair for a period of time ranging from 5 to 60 minutes in an atmosphere having a relative humidity of from about 35 to 80 percent, at a temperature from about 35° C. to 75° C. whereby moisture is imparted to said hair, the amount of imparted moisture, measured as a percentage relative to the weight of said hair prior to being moisturized, only differs from the weight of said dried hair resulting from drying step (c) by less than 2 percent, and (e) unrolling said hair.

2. The method of claim 1 wherein the relative humidity during conditioning step (c) corresponds to the relative humidity of the outside atmosphere with which said conditioned hair comes into contact subsequent to said conditioning step (c).

3. The method of claim 1 wherein said conditioning step (c) is carried out at a temperature of from 45° to 60° C.

4. The method of claim 3 wherein said conditioning step (c) is carried out at a temperature of about 50° C.

5. The method of claim 1 wherein the temperature maintained during said conditioning step (c) is substantially equal to the temperature maintained during drying step (b).

6. The method of claim 1 wherein said conditioning step (c) is carried out for a period of time ranging from about 10 to 20 minutes.

7. The method of claim 1 wherein said conditioning step (d) is effected by introducing steam into the atmosphere surrounding the hair.

8. The method of claim 1 which includes during conditioning step (c) introducing into said atmosphere a hair treating cosmetic selected from an antiseborrhea agent, an anti-dandruff agent, an anti-drop agent, a film forming resin, a deodorant, a disinfectant, a perfume or a brilliantine.

9. The method of claim 1 where in drying step (c), said drying is continued for a time until the relative humidity in the atmosphere surrounding the hair during said drying step is approximately 15 percent.

10. The method of claim 1 wherein drying step (c) is carried out at a temperature between 40° and 70° C. for a time ranging from 10 to 60 minutes.

11. The method of claim 1 wherein drying step (c) is effected by an open circuit flow of air, taken from the outside and then heated.

12. The method of claim 1 wherein hair moisturizing step (a) comprises wetting said hair with water, a shampoo or an aqueous or hydroalcoholic solution.

13. The method of claim 1 wherein subsequent to hair unrolling step (e) a non-wetting cosmetic agent is applied to said hair.

14. The method of claim 1 wherein said hair shaping means comprises curlers or rollers having a diameter such that the resulting set hair has a wavy configuration.

15. The method of claim 1 wherein said hair shaping means comprises curlers or rollers having a sufficiently large diameter such that the resulting set hair has a straightened configuration.

16. The method of claim 1 wherein the hair being moisturized in step (a) is natural, bleached, dyed or permed hair.

* * * * *

UNITED STATES PATENT AND TRADEMARK OFFICE

CERTIFICATE OF CORRECTION

PATENT NO. : 4,481,961

DATED : November 13, 1984

INVENTOR(S) : Daniel P. Bauer, et al

It is certified that error appears in the above—identified patent and that said Letters Patent is hereby corrected as shown below:

Column 10, lines 53 to 58, delete "whereby moisture is imparted...less than 2 percent, and" and insert therefor --wherein during the conditioning step, moisture is again imparted to the hair, said imparted moisture, measured as a percentage relative to the weight of the hair prior to moisturizing said hair in step (a) only differs from the weight loss of moisture during drying said hair in step (c), measured as a percentage relative to the weight of the hair prior to moisturizing said

UNITED STATES PATENT AND TRADEMARK OFFICE

CERTIFICATE OF CORRECTION

PATENT NO. : 4,481,961

DATED : November 13, 1984

INVENTOR(S) : Daniel P. Bauer, et al.

It is certified that error appears in the above-identified patent and that said Letters Patent is hereby corrected as shown below:

hair in step (a), by less than 2 percent, and --.

Signed and Sealed this

*Tenth* Day of *December 1985*

[SEAL]

*Attest:*

DONALD J. QUIGG

*Attesting Officer*

*Commissioner of Patents and Trademarks*